US007080744B2

(12) United States Patent
Robertson

(10) Patent No.: US 7,080,744 B2
(45) **Date of Patent: *Jul. 25, 2006**

(54) VENTED COOLER DOOR SHELF DEVICE

(75) Inventor: James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 27 days.

This patent is subject to a terminal disclaimer.

(21) Appl. No.: 10/947,472

(22) Filed: Sep. 22, 2004

(65) Prior Publication Data

US 2006/0060549 A1 Mar. 23, 2006

(51) Int. Cl.
*A47B 73/00* (2006.01)

(52) U.S. Cl. ..... 211/75; 211/74

(58) Field of Classification Search ..... 211/88.01, 211/75, 87.01, 59.4, 71.01, 85.18, 72, 90.01, 211/73, 85.23, 74, 88.03, 86.01, 126.1, 89.01; 248/206.4, 205.5, 206.3; 40/642, 650; D6/574
See application file for complete search history.

(56) References Cited

U.S. PATENT DOCUMENTS 1,840,763 A * 1/1932 Benchley ..... 248/206.3
4,984,693 A * 1/1991 Belokin et al. ..... 211/88.01
5,096,272 A * 3/1992 Belokin et al. ..... 312/129
5,330,261 A * 7/1994 Bennett ..... 312/321.5
5,333,745 A * 8/1994 Lehmann ..... 211/88.01
5,358,128 A * 10/1994 Belokin et al. ..... 211/75
5,913,433 A 6/1999 Beloklin et al.
6,571,967 B1 * 6/2003 Belokin et al. ..... 211/71.01
6,588,606 B1 * 7/2003 Miller et al. ..... 211/88.01
6,779,670 B1 * 8/2004 Primiano et al. ..... 211/74
2003/0209505 A1 * 11/2003 Belokin et al. ..... 211/75
2003/0222037 A1 * 12/2003 Belokin et al. ..... 211/75
2004/0055481 A1 * 3/2004 Klassen et al. ..... 101/3.1

* cited by examiner

*Primary Examiner*—Richard E. Chilcot, Jr.
*Assistant Examiner*—Lindsay M. Maguire
(74) *Attorney, Agent, or Firm*—John L. James

(57) ABSTRACT

A shelf device for mounting on an inside surface of a cooler door comprises a bottom panel and left and right mounting flanges connected to the bottom panel along left and right side edge portions thereof. Each flange has a pair of openings therein vertically spaced from one another and adapted to mount and support the shelf device. A partition panel is connected to the bottom panel and mounting flanges divides the bottom panel into a plurality of compartments. Vertically extending ribs are attached to the partition panel at junctions of adjacent compartments. A display panel is spaced from the bottom panel and attached to the ribs. The display panel includes top and bottom lips forming a slot for slidably receiving a display insert.

7 Claims, 5 Drawing Sheets

VENTED COOLER DOOR SHELF DEVICE

CROSS REFERENCE TO RELATED APPLICATIONS

This application is related to commonly assigned co-pending applications Ser. No. 10/929,975 filed Aug. 20, 2004 entitled "Cooler Door Shelf Device With Removable Product Panel"; Ser. No. 10/944,246, filed Sep. 16, 2004 entitled "Cooler Door Shelf Device With Stick-On Display Panels"; Ser. No. 10/944,295, filed Sep. 16, 2004 entitled "Cooler Door Shelf Device With Raised Panels"; and co-filed application Ser. No. 10/947,467, entitled "Neck-Hanging Cooler Door Shelf Device".

TECHNICAL FIELD OF THE INVENTION

This invention relates generally to a cooler, and, more particularly, to a door shelf device for a transparent cooler door.

BACKGROUND OF THE INVENTION

Upright coolers in supermarkets and convenience stores typically have transparent glass doors so that the products inside are visible. It is now common to use the inside of the door for shelving as is done in household refrigerators. Door shelving fits against the door so that the product containers are visible, however the product labels do not always face forward for easy identification of the product. Some shelves have a small area for affixing product identification, but such small areas lack the impact needed, especially for impulse purchases. Accordingly, it will be appreciated that it would be highly desirable to have a door shelf with a large area for product labeling and identification.

A display shelf which employs a mounting or support panel for attachment to one face of a transparent wall is disclosed in U.S. Pat. No. 5,913,433. The display shelf has a floor which projects from the top edge of the support panel and a containment wall which projects upwardly from the floor. The support panel does not extend above the floor in the area which supports displayed product so that the product is visible through the transparent wall. Advertising material may be displayed on the support panel below the floor and the containment wall and/or floor may be appropriately shaped to provide individual compartments for each unit of product displayed. The display shelf is supported on a cooler door by suction cups which anchor in openings in flanges wherein one opening is above the floor and the other opening is below the floor. Advertising on the support panel cannot be changed while the shelf is attached to the cooler door because the lower openings and suction cups block access. Accordingly, it will be appreciated that it would be highly desirable to have a display shelf device that allows the advertising to be changed while the shelf device is attached to the cooler door.

Also, the support or mounting panel and floor intersect which inhibits the free circulation of air in the cooler. It is desirable to have a shelf device wherein the floor and display panel do not intersect and which promotes the free circulation of air to keep refrigerated products chilled.

SUMMARY OF THE INVENTION

The present invention is directed to overcoming one or more of the problems set forth above. Briefly summarized, according to one aspect of the present invention a shelf device for mounting on an inside surface of a cooler door comprises a bottom panel having front, rear, left and right side edge portions. Left and right mounting flanges connected to the bottom panel along the respective left and right side edge portions extend upward therefrom. Each flange has a pair of openings therein vertically spaced from one another and adapted to mount and support the shelf device. A partition panel is connected to the bottom panel and mounting flanges dividing the bottom panel into a plurality of compartments to fit the configuration of articles therein.

A plurality of vertically extending support ribs are attached to the partition panel at junctions of adjacent compartments. A display panel is spaced from the bottom panel and is attached to the plurality of ribs. The space between the display panel and bottom panel allows the free flow of air to keep products on the shelf device chilled.

The shelf device is attached to the inside surface of the cooler door using suction cups with a protrusion. The protrusions fit through the openings in the mounting flanges to anchor the shelf device to the door. The shelf device utilizes space in the cooler that would otherwise be wasted and increases visual appeal product identification at the door where it is more readily seen than that on the containers in the cooler.

A display panel is attached to the left and right mounting flanges and is spaced from the bottom panel. The display panel includes top and bottom lips forming a slot for slidably receiving a display insert. Because the shelf device is supported via openings in the flanges above the display panel, the insert can be inserted and removed while the shelf device is mounted on the cooler door.

According to another aspect of the invention, the plurality of vertically extending support ribs are attached to the partition panel at junctions of adjacent compartments. The display panel is spaced from the bottom panel and is attached to the plurality of ribs. Also, a rear portion of the partition panel is spaced from a rear portion of the bottom panel. The spaces between the display panel and bottom panel and partition panel and bottom panel improve air circulation to keep products on the shelf device chilled.

According to yet another aspect of the invention, there are plurality of support ribs attached to a bottom surface of the bottom panel and to the display panel. The display panel is spaced from the bottom panel and is attached to both plurality of ribs. Also, a rear portion of the partition panel is spaced from a rear portion of the bottom panel. The spaces between the display panel and bottom panel and partition panel and bottom panel improve air circulation to keep products on the shelf device chilled.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
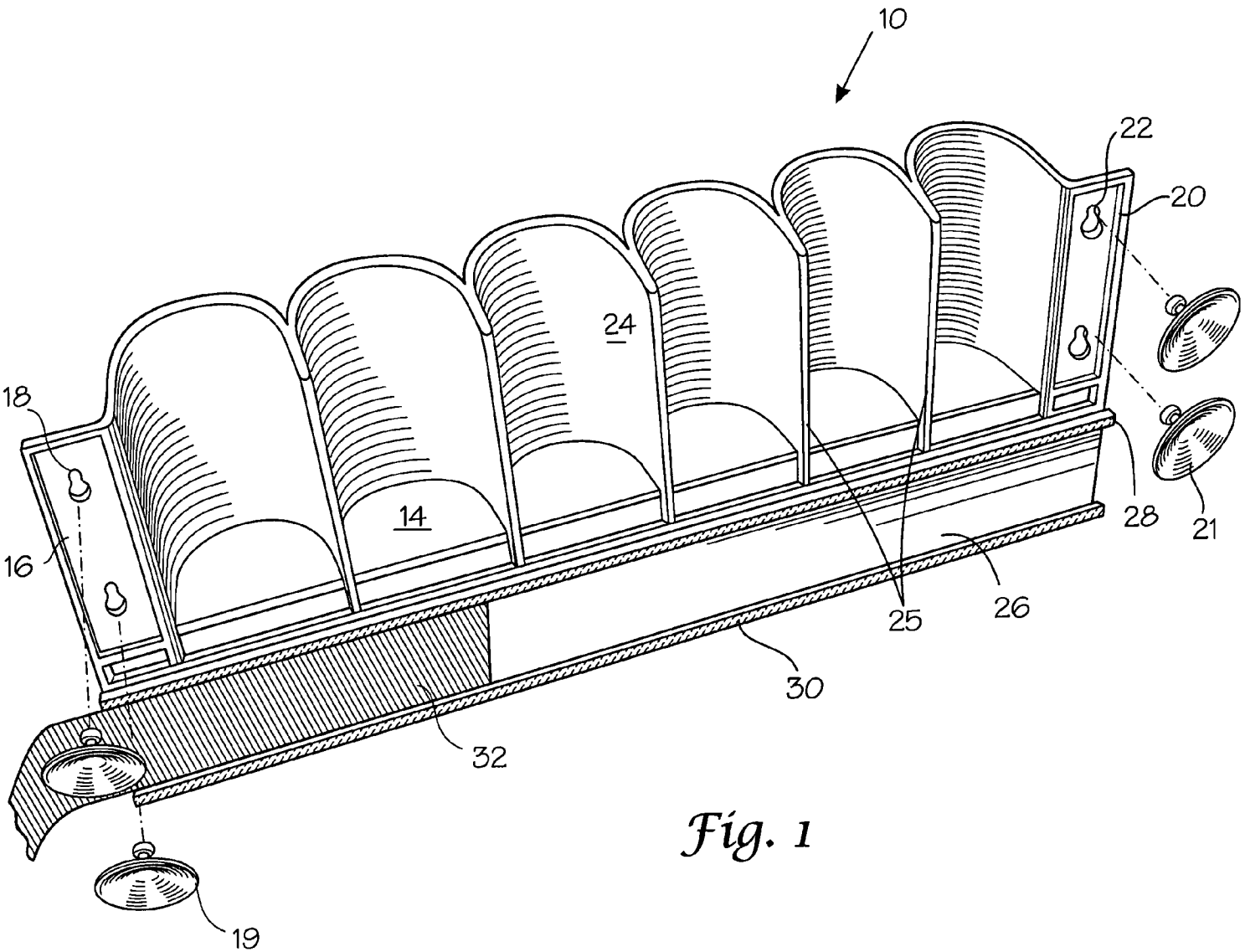
FIG. 1 is a front perspective view of a shelf device for attaching to the inside surface of an upright cooler door according to the present invention.
Figure 2:
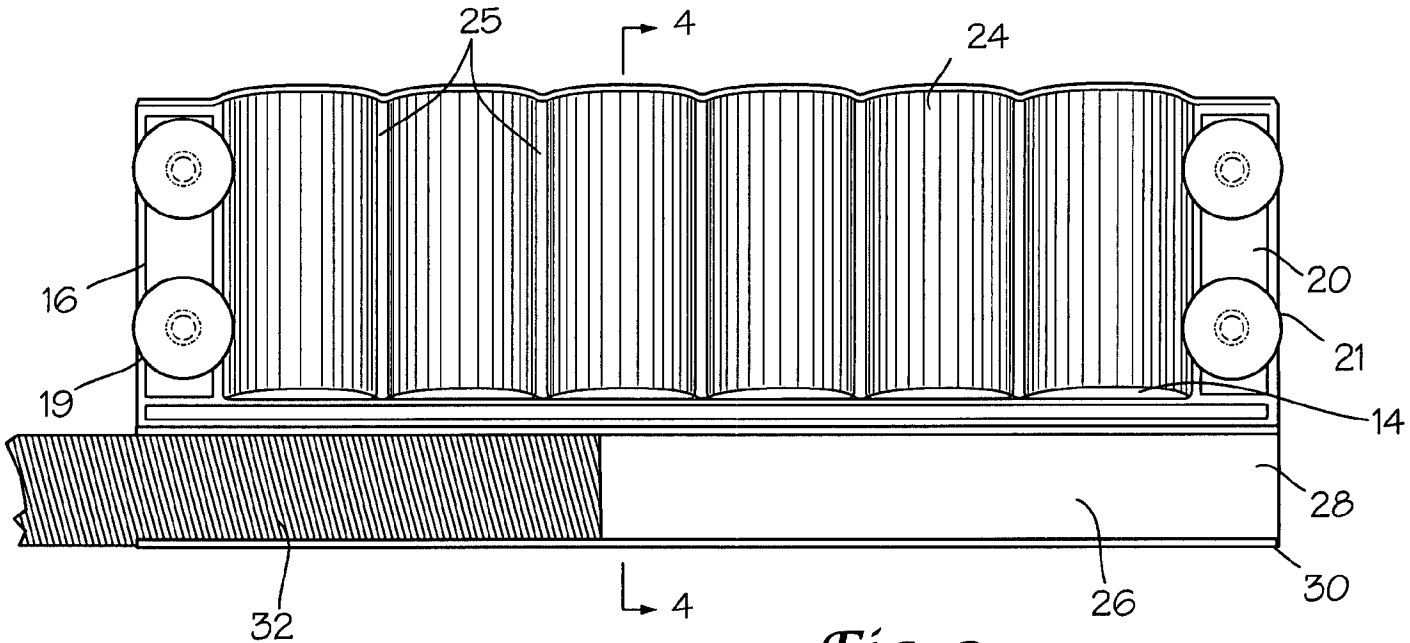
FIG. 2 is a diagrammatic front view of the shelf device of FIG. 1.
Figure 3:
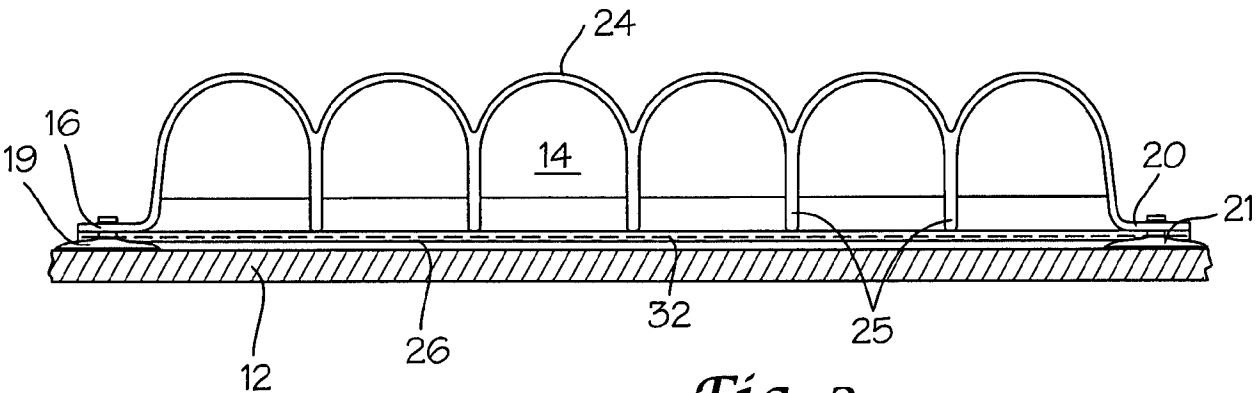
FIG. 3 is a diagrammatic top view of the shelf device taken of FIG. 1.
Figure 4:
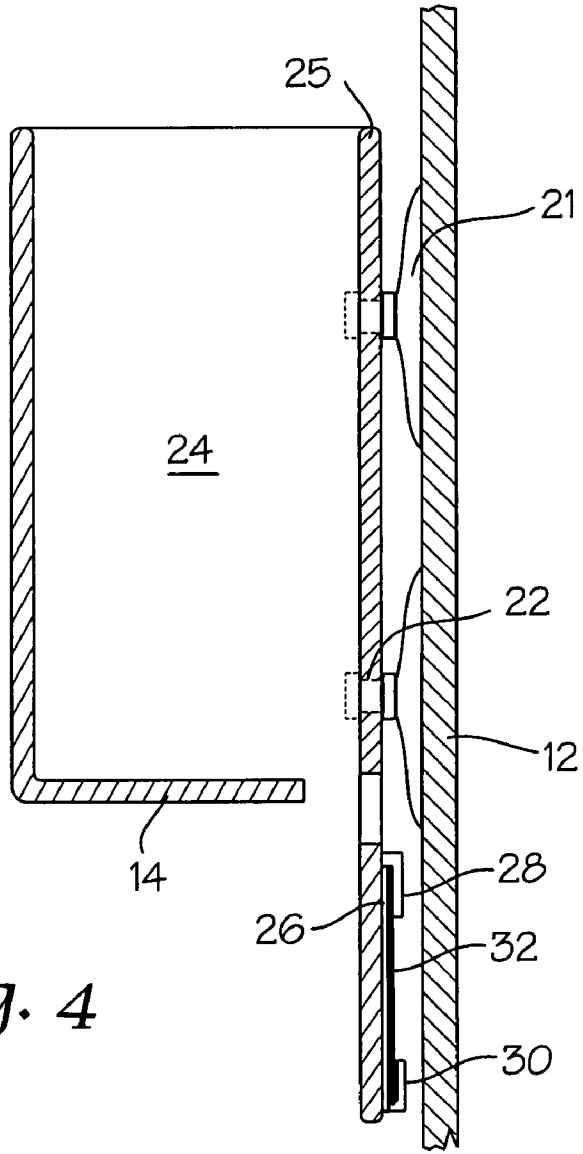
FIG. 4 is a diagrammatic sectional view taken along line 4—4 of FIG. 2.

Referring to FIGS. 1–4, a shelf device 10 is attached to an inside surface of an upright cooler door 12. Articles, such as beverage containers for example, can be placed on shelf device 10 for easy viewing through the cooler door 12 which minimizes the need to open the door to view the contents. It also utilizes the door space for storing additional product in a space that would otherwise be wasted.

Shelf device 10 has a bottom panel 14 with front, rear, left and right side edge portions. A left mounting flange 16 is connected to bottom panel 14 along the left side edge portion and extends upward therefrom. Left mounting flange 16 has a pair of keyways or slotted openings 18 therein vertically spaced from one another and adapted to mount and support the shelf device in conjunction with studs or suction cups 19. Similarly, a right mounting flange 20 is connected to bottom panel 14 along the right side edge portion and extends upward therefrom. Right mounting flange 20 has a pair of slotted openings 22 therein vertically spaced from one another and adapted to mount and support the shelf device in conjunction with studs or suction cups 21.

A partition panel 24 is connected to bottom panel 14 and the left and right mounting flanges 16, 20 dividing bottom panel 14 into a plurality of compartments. Partition panel 24 extends upward from bottom panel 14. As illustrated, the compartments are curved to fit the contour of beverage bottles, but can be contoured to fit other container shapes.

A supporting rib 25 is formed at the junction of adjacent segments of partition panel 24 and extends downward preferably terminating below bottom panel 14. Ribs 25 are spaced from bottom panel 14 which is recessed from the front of the shelf device. The resulting space improves air circulation.

A display panel 26 is attached to the left and right mounting flanges 16, 20, preferably below bottom panel 14. Display panel 26 is spaced from bottom panel 14 and thus does not contribute to the support of the shelf device 10. The spacing improves air circulation. Top and bottom flanges or lips 28, 30 form a slot for slidably receiving a display insert 32. Each lip may be a long, single lip or may be a series of shorter lips extending across display panel 26.

Figure 5:
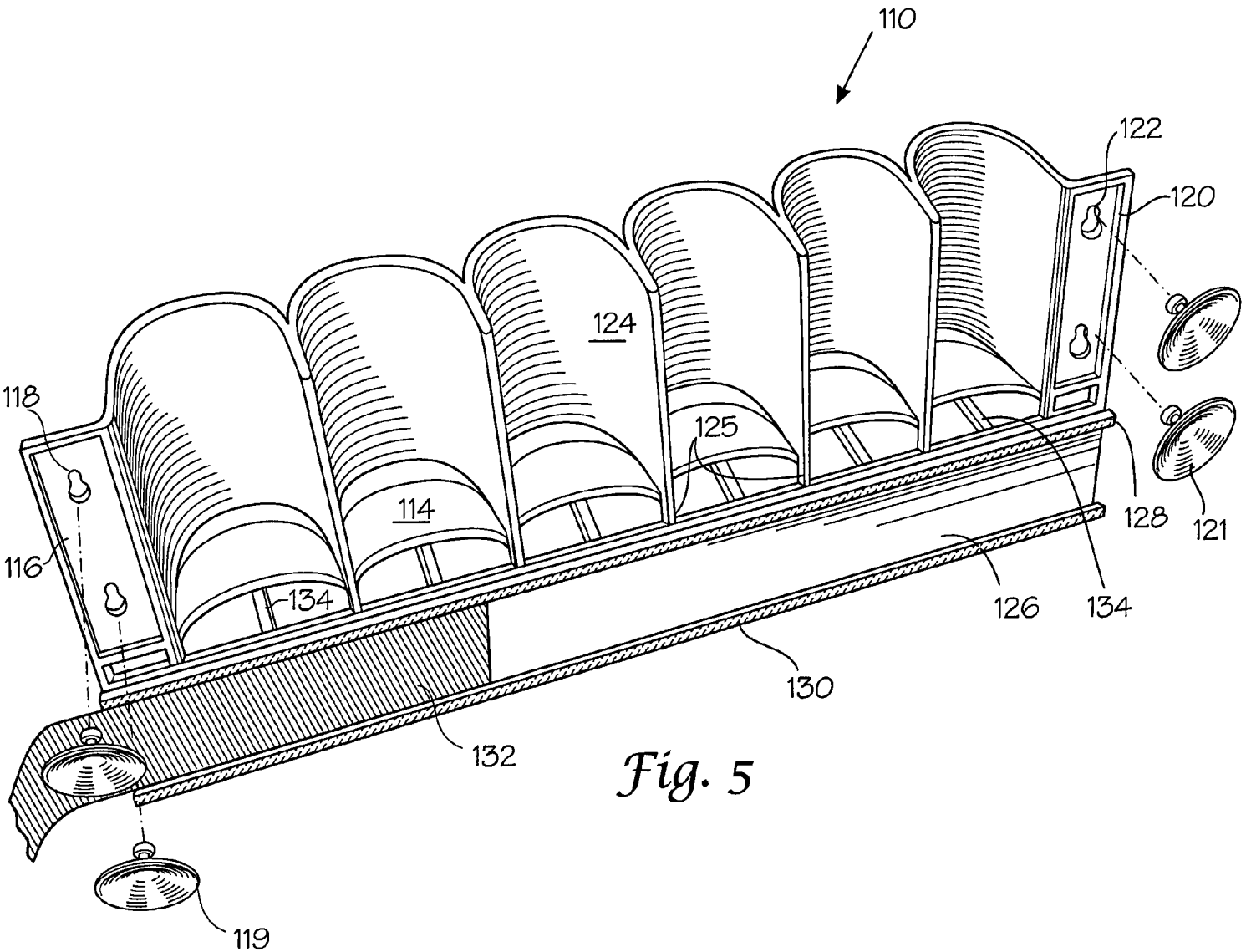
FIG. 5 is a front perspective view of another preferred embodiment of a shelf device according to the present invention.
Figure 6:
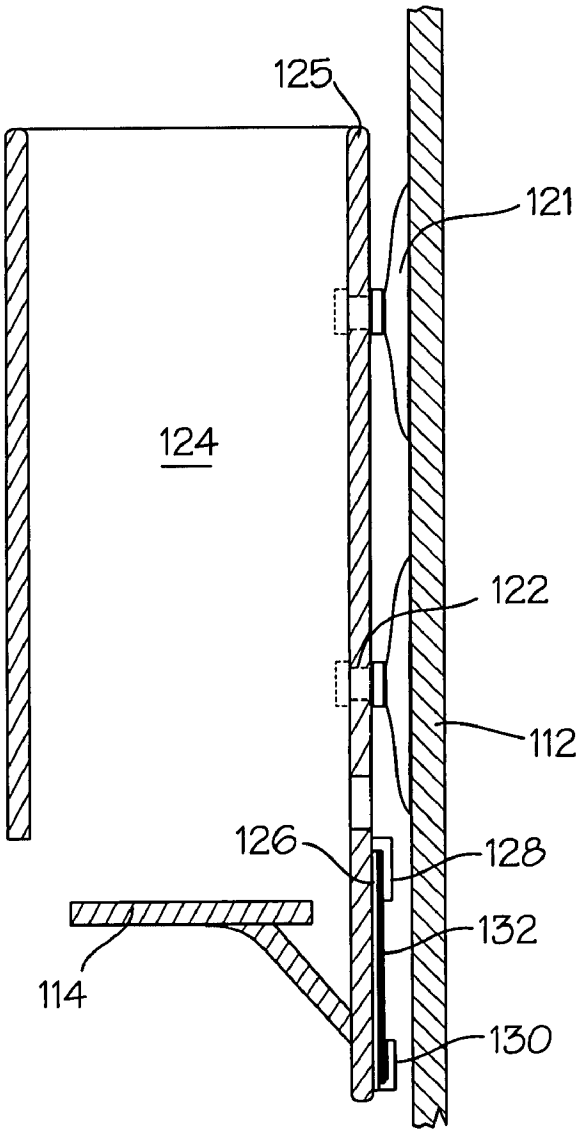
FIG. 6 is a diagrammatic sectional of the device of FIG. 5 similar to FIG. 4.

Referring now to FIGS. 5–6, a shelf device 110 is attached to an inside surface of an upright cooler door 112. Articles can be placed on shelf device 110 for easy viewing through the cooler door 112.

Shelf device 110 has a bottom panel 114 with front, rear, left and right side edge portions. A left mounting flange 116 is connected to bottom panel 114 along the left side edge portion and extends upward therefrom. Left mounting flange 116 has a pair of keyways or slotted openings 118 therein vertically spaced from one another and adapted to mount and support the shelf device in conjunction with studs or suction cups 119. Similarly, a right mounting flange 120 is connected to bottom panel 114 along the right side edge portion and extends upward therefrom. Right mounting flange 120 has a pair of slotted openings 122 therein vertically spaced from one another and adapted to mount and support the shelf device in conjunction with studs or suction cups 121.

A partition panel 124 is connected to bottom panel 114 and the left and right mounting flanges 116, 120 dividing bottom panel 114 into a plurality of compartments. Partition panel 124 extends upward from bottom panel 114 except at the rear where there is a spaced provided to improve air circulation. As illustrated, the compartments are curved to fit the contour of beverage bottles, but can be contoured to fit other container shapes.

A supporting rib 125 is formed at the junction of adjacent segments of partition panel 124 and extends downward preferably terminating below bottom panel 114. Ribs 125 are spaced from bottom panel 114 which is recessed from the front of the shelf device. The resulting space improves air circulation.

A display panel 126 is attached to the left and right mounting flanges 116, 120, preferably below bottom panel 114. Display panel 126 is spaced from bottom panel 114 and thus does not contribute to the support of the shelf device 110. Shelf device 110 is supported on the cooler door 112 by left and right mounting flanges 116, 120. The spacing improves air circulation. Top and bottom flanges or lips 128, 130 form a slot for slidably receiving a display insert 132. Each lip may be a long, single lip or may be a series of shorter lips extending across display panel 126.

While the invention has been described with particular reference to the preferred embodiments, it will be understood by those skilled in the art that various changes may be made and equivalents may be substituted for elements of the preferred embodiments without departing from invention. For example, while it is anticipated that the shelf device will be integrally molded of transparent plastic, opaque plastic could be used. It is accordingly intended that the claims shall cover all such modifications and applications as do not depart from the true spirit and scope of the invention.

Element List

10 shelf device
12 upright cooler door
14 bottom panel
16 left mounting flange
18 left mounting flange slotted openings
19 suction cup
20 right mounting flange
21 suction cups
22 right mounting flange slotted openings
24 partition panel
25 supporting rib
26 display panel
28, 30 top and bottom flange or lip
32 display insert
110 shelf device
112 upright cooler door
114 bottom panel
116 left mounting flange
118 left mounting flange sloted opening
119 suction cup
120 right mounting flange
121 suction cup
122 right mounting flange slotted opening
124 partition panel
125 supporting rib
126 display panel
128, 130 top and bottom flange or lip
132 display insert

What is claimed is:

1. A shelf device for an inside surface of a cooler door, comprising:

a bottom panel having front, rear, left and right side edge portions;

a left mounting flange connected to said bottom panel along said left side edge portion and extending upward therefrom, said left mounting flange having a pair of openings therein vertically spaced from one another and adapted to mount and support said shelf device;

a right mounting flange connected to said bottom panel along said right side edge portion and extending upward therefrom, said right mounting flange having a pair of openings therein vertically spaced from one another and adapted to mount and support said shelf device;

a partition panel connected to said bottom panel and said left and right mounting flanges dividing said bottom panel into a plurality of compartments;

a plurality of vertically extending ribs attached to said partition panel at junctions of adjacent compartments; and a display panel spaced from said bottom panel creating a gap between said display panel and said bottom panel, a lower portion of each rib of said plurality of ribs extending downwardly through said gap to said display panel fastening said display panel to said ribs.

2. A shelf device, as set forth in claim 1, wherein said display panel is attached to said left and right mounting flanges.

3. A shelf device, as set forth in claim 1, wherein said display panel includes top and bottom lips forming a slot for slidably receiving a display insert.

4. A shelf device, as set forth in claim 1, including a plurality of supporting ribs attached to a bottom surface of said bottom panel and to said display panel.

5. A shelf device for an inside surface of a cooler door, comprising:

a bottom panel having front, rear, left and right side edge portions;

a left mounting flange connected to said bottom panel along said left side edge portion and extending upward therefrom, said left mounting flange having a pair of openings therein vertically spaced from one another and adapted to mount and support said shelf device;

a right mounting flange connected to said bottom panel along said right side edge portion and extending upward therefrom, said right mounting flange having a pair of openings therein vertically spaced from one another and adapted to mount and support said shelf device;

a partition panel connected to said bottom panel and said left and right mounting flanges dividing said bottom panel into a plurality of compartments;

a plurality of vertically extending ribs attached to said partition panel at junctions of adjacent compartments;

a display panel attached to said left and right mounting flanges and spaced from said bottom panel creating a gap between said display panel and said bottom panel, a lower portion of each rib of said plurality of ribs extending downwardly through said gap to said display panel fastening said display panel to said ribs; and a plurality of support ribs attached to a bottom surface of said bottom panel and to said display panel.

6. A shelf device, as set forth in claim 5, wherein said display panel includes top and bottom lips forming a slot for slidably receiving a display insert.

7. A shelf device for an inside surface of a cooler door, comprising:

a bottom panel having front, rear, left and right side edge portions;

a left mounting flange connected to said bottom panel along said left side edge portion and extending upward therefrom, said left mounting flange having a pair of openings therein vertically spaced from one another and adapted to mount and support said shelf device;

a right mounting flange connected to said bottom panel along said right side edge portion and extending upward therefrom, said right mounting flange having a pair of openings therein vertically spaced from one another and adapted to mount and support said shelf device;

a partition panel mounted atop said bottom panel and said left and right mounting flanges dividing said bottom panel into a plurality of compartments;

a plurality of vertically extending ribs attached to said partition panel at junctions of adjacent compartments and having lower portions extending below said bottom panel; and a display panel fastened to said lower portions of said plurality of ribs while being free of connection to said bottom panel.

* * * * *